US005539396A

United States Patent [19]

Mori et al.

[11] Patent Number: 5,539,396

[45] Date of Patent: Jul. 23, 1996

[54] REMOTE MONITORING SYSTEM FOR INSTRUMENTATION

[75] Inventors: Takeshi Mori; Hiromi Ohkawa; Junji Kojima, all of Miyanohigashi-machi, Japan

[73] Assignee: Horiba, Ltd., Kyoto, Japan

[21] Appl. No.: 126,356

[22] Filed: Sep. 24, 1993

[30] Foreign Application Priority Data

Sep. 28, 1992 [JP] Japan ..... 4-282469

[51] Int. Cl.[6] ..... G08C 19/16

[52] U.S. Cl. ..... 340/870.01; 340/500; 340/511; 340/870.13; 340/870.16

[58] Field of Search ..... 340/870.13, 825.06, 340/870.16, 870.17, 870.01–870.03, 500, 511; 455/68–70, 103, 38.3; 370/95.1, 95.3

[56] References Cited

U.S. PATENT DOCUMENTS

| | | | |
|---|---|---|---|
| 4,275,382 | 6/1981 | Jannotta | 340/870.17 |
| 4,689,729 | 1/1987 | Savit | 340/870.13 |
| 4,796,027 | 1/1989 | Smith-Vaniz | 340/870.03 |
| 4,823,290 | 4/1989 | Fasack et al. | 340/870.17 |
| 4,865,044 | 9/1989 | Wallace et al. | 340/870.17 |
| 5,265,270 | 11/1993 | Stengel et al. | 455/343 |

*Primary Examiner*—Brent A. Swarthout
*Assistant Examiner*—Ashok Mannava
*Attorney, Agent, or Firm*—Price, Gess & Ubell

[57] ABSTRACT

A remote monitoring system for instrumentation that is capable of measuring certain characteristics of a process such as a pH value includes an instrument for providing a measurement output signal which can be stored. A comparison circuit can compare the output signal with a predetermined value. A transmitter can transmit when the output signal exceeds the predetermined value, and a receiver can receive the output signal and convert it into a measured result. The instrumentation can be pulled from the receiver and the output signals can be encoded to identify a particular instrument with distinct transmission time periods available in a plurality of transmitting channels.

15 Claims, 9 Drawing Sheets

REMOTE MONITORING SYSTEM FOR INSTRUMENTATION

BACKGROUND OF THE INVENTION

1. Field of the Invention

The present invention relates to an instrumentation system that is capable of accumulating measurement data and analyzing the data from various types of remotely-located analytical machines and instruments and, more particularly, to an efficient system for monitoring and collecting the data in an economical manner by a wireless system.

2. Description of Related Art

Various forms of instrumentation are used to monitor activities such as production processes. For example, the transient pH value of a liquid can be important to ensure proper production procedures. As shown in FIG. 7, a conventional general pH meter having a measuring electrode 71 is adapted to provide electrode signals through a highly insulating signal cable 73 to a meter 72. The meter 72 will receive the electrode signals and produce a display or recording of the measured results. As schematically shown in FIG. 7, an impedance conversion circuit 74 can receive an analog signal from the measuring electrode 71 and an A/D converter 75 can convert the analog signal into a digital signal. A computer system or CPU 76 can receive the digital signals for processing, and can be further powered by a power source such as a battery, shown as element 77.

Another example of a metering instrument is shown in FIG. 8 as meter 82. It can service a plurality of measuring electrodes 81 through the use of a switchover or changeover box 83, so that the respective outputs of the measuring electrodes 81 can be conveyed to the signal cables 84, and then through the switch mechanism 83 to the output cable 85. This instrument has the capacity of providing output signals from a number of separate measuring electrodes to a common meter 82.

In particular applications, a problem can occur in positioning the signal cables 73 and 84, as shown in FIGS. 7 and 8, when the sample liquid to be measured is preferably distant from the actual meters 72 or 83. In addition, it may be difficult to access the liquid sample. Also, as shown in FIG. 8, an additional disadvantage has occurred in that a significant number of cables 84 is increased, depending upon the number of desired measuring electrodes 81.

There have been suggestions to remotely monitor electrode signals, with the information being wirelessly transmitted to a remotely located meter, and the measured result being displayed on or recorded in the meter. In this regard, a single meter can service a plurality of measuring electrodes as disclosed in, for example, Japanese Utility Model Application Laid-Open No. Sho 59-84698. With this approach, a signal cable for connecting the measuring electrodes with the meter is unnecessary, and the measuring electrodes and the meter can be freely moved to a measuring site separately and independently.

However, when the electrode signals are converted from an analog to a digital format, and the measured data obtained as a result of this A/D conversion are wirelessly transmitted to the meter, a substantial expenditure of energy, considerably more than required for the A/D conversion, is consumed by the transmission of the electrical waves in a transmitting portion, as shown in the graph of FIG. 9. Thus, power consumption becomes a factor. In addition, in the case of a multichannel measurement, if transmitting intervals are made constant over all the channels when the measured data are being transmitted at the same frequency, the electrical waves are overlapped to disturb the normal receiving pattern, which can cause errors. Finally, a transmitting and receiving, or double direction communication, is not possible between the measuring electrodes and the meter in such an instrumentation system.

Thus, the prior art is still seeking to optimize a monitoring system for analytical instrumentation.

OBJECTS AND SUMMARY OF THE INVENTION

It is an object of the present invention to reduce the consumption of electrical power in a transmitting portion and to improve the transmission timing in a multichannel measurement procedure.

It is a further object to improve the instrumentation system that adopts a wireless transmission of measured data, and to provide an instrumentation system capable of conducting two-way communication.

The present invention can convert an analytical signal from an analytical instrumentation into a digital signal and can determine a measured datum level resulting from the A/D conversion. This datum level can be wirelessly transmitted and the measured result can be displayed or recorded. In the present system, a difference of a predetermined value or greater value is required to be measured between the present measured datum signal and the previous measured datum signal that had been transmitted in the last measurement cycle. If that datum signal level or predetermined value is not exceeded, then the datum signal is not transmitted.

The instrumentation "system of the present invention further provides the capability of transmitting measurements from a plurality of electrode signals, or from a plurality of analytical machines and instruments, for display or recording in a meter that is common to such measuring instruments, wherein the transmitting intervals in a plurality of channels will be different from each other.

The present invention also provides a capacity for receiving at the measuring instrumentation, analytical machine or tool a signal, to thereby provide a two-way communication.

The meter of the present invention can also provide an analytical portion-discriminating code, a meter-discriminating code, and a datum-requiring code, so that only the desired analytical instrument corresponding to the analytical portion-discriminating code will transmit a meter-discriminating code, the analytical portion-discriminating code, and digital converted measured data.

In one form of the invention, the analytical machine or instrumentation can be a pH meter, and the analytical portion is a measuring electrode that provides an electrode signal to be A/D converted.

In accordance with the present invention, there is a reduction in the consumption of electrical power in the transmitting portion, while avoiding a reduction of response speed. Therefore, remote power sources such as batteries can have an extended life. The present invention also avoids any overlapping electrical waves during transmission between the transmission channels. Thus, transmission accuracy can be improved. Since the instrumentation can also receive a transmission from the meter, better communication can be established. In addition, wasteful transmissions can be eliminated. Thus, measured data can be provided in an economical manner.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide an improved monitoring system for remotely-located instrumentation.

Figure 1:
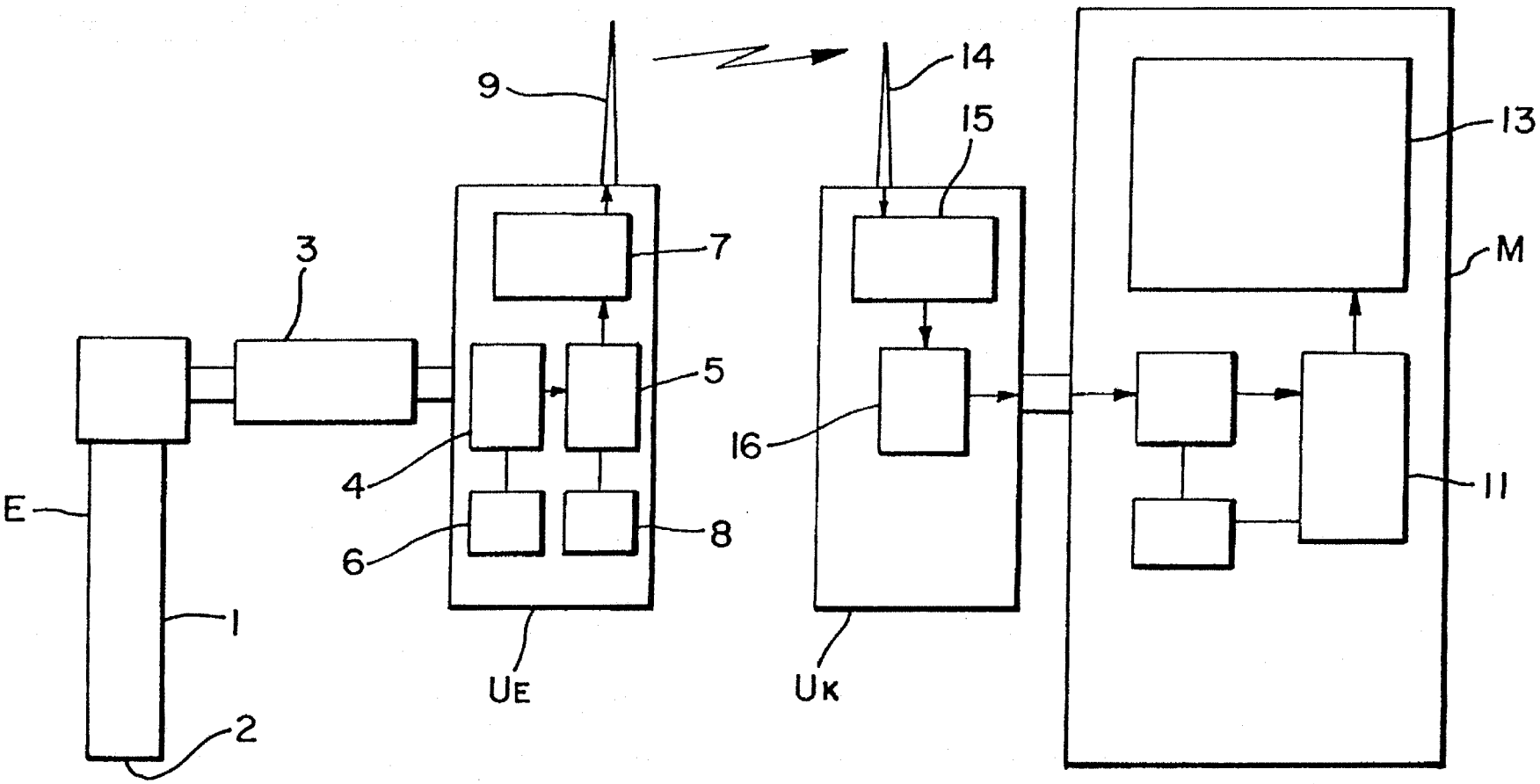
FIG. 1 is a schematic block diagram showing an example of a construction of a single direction communication-type instrumentation system according to the present invention.

FIG. 1 shows a first preferred embodiment of an instrumentation monitoring system in accordance with the present invention. A measuring electrode E (analytical portion of a pH meter) capable of measuring the pH of a liquid sample is provided with a pH-measuring portion 2 formed at an end portion of an electrode body 1 and adapted to obtain an electrode signal (analytical signal) by immersing the pH-measuring portion 2 in a sample liquid (not shown). The measuring electrode E is connected with a communication unit $U_E$ through a circuit 3 that is capable of impedance converting the electrode signal. A remote meter M is capable of displaying or recording the results measured by the measuring electrode E, and is connected with a communication unit $U_M$ for receiving a transmission of electrical waves from the communication unit $U_E$.

It is not necessary that the meter M only be connected with one measuring electrode E, as shown in FIG. 1. As can be seen in a second preferred embodiment of FIG. 2, a plurality of measuring electrodes $E_1$ through $E_4$, for example, can be provided with a plurality of respective communication units $U_{E1}$ to $U_{E4}$ to form a multichannel structure with the communication unit $U_M$ and the meter M.

The communication unit $U_E$ comprises an A/D converter 4 for converting the impedance-converted electrode signal into a digital measuring datum. The communication unit $U_E$ also contains a CPU 5 having a function of encoding the measured datum and giving a measuring electrode-discriminating code for discriminating the measuring electrode E, to thereby identify the transmitted measured datum, an operating portion 6, a high-frequency transmitting portion 7 or transmitter, a power source 8, and a transmission antenna 9. The operating portion 6 can include an ON/OFF switch for the power source and a measurement starting switch. These elements constitute a transmitting unit. The encoded measured datum is transmitted from the high-frequency transmitting portion 7 after a preamble of the measuring electrode-discriminating code.

The meter M is provided with an I/O connection 10, a CPU 11 which is capable of providing the operation procedure's control, memory, and the like, and a power source 12. A display portion 13 displays the results of the measurement on an appropriate operator display. As can be appreciated, the results can also be stored or printed out on a hard copy. The communication unit $U_M$ comprises an antenna 14 for receiving the transmitted electrical waves from the communication unit $U_E$, a high-frequency receiving portion 15, and a CPU 16 having a function of discriminating the specific measuring electrode-discriminating code, decoding the encoded measuring datum, and transmitting these signals to the meter M. The communication unit $U_M$ acts as a receiver unit.

In the form of the invention shown in FIG. 1, the electrode signal that expresses a pH value of the sample liquid is obtained in the pH-measuring portion 2 of the measuring electrode E. The impedance of the signal is converted in an impedance conversion circuit 3 and then transmitted to the communication unit $U_E$. The electrode signal placed in the communication unit $U_E$ is A/D converted in an A/D converter 4 to be turned into a measured datum. This information of the electrode signal substantially represents a real-time measurement signal. This measured datum is encoded in the CPU 5 and transmitted through the transmission antenna 9 as an electrode wave transmission, together with the measuring electrode-discriminating code, through the high-frequency transmitting circuit portion 7. As can be appreciated, a clock can provide an address time signal for storing in a memory measurement which can be transmitted at a later time period.

The electrode waves in the communication unit $U_E$ are received by the receiving antenna 14 and then processed through the high-frequency receiving portion circuit 15 of the communication $U_M$. The received message is discriminated by the measuring electrode-discriminating code processing in CPU 16, and is then transmitted to the CPU 11 of the meter M through I/O interface 10 after the measured datum has been decoded. This information is then processed in the CPU 11 so that a pH value can then be displayed on a display portion 13. As a result, the measurement of a pH value can be displayed on the meter, and can also be recorded or stored, as may be desired.

Figure 9:
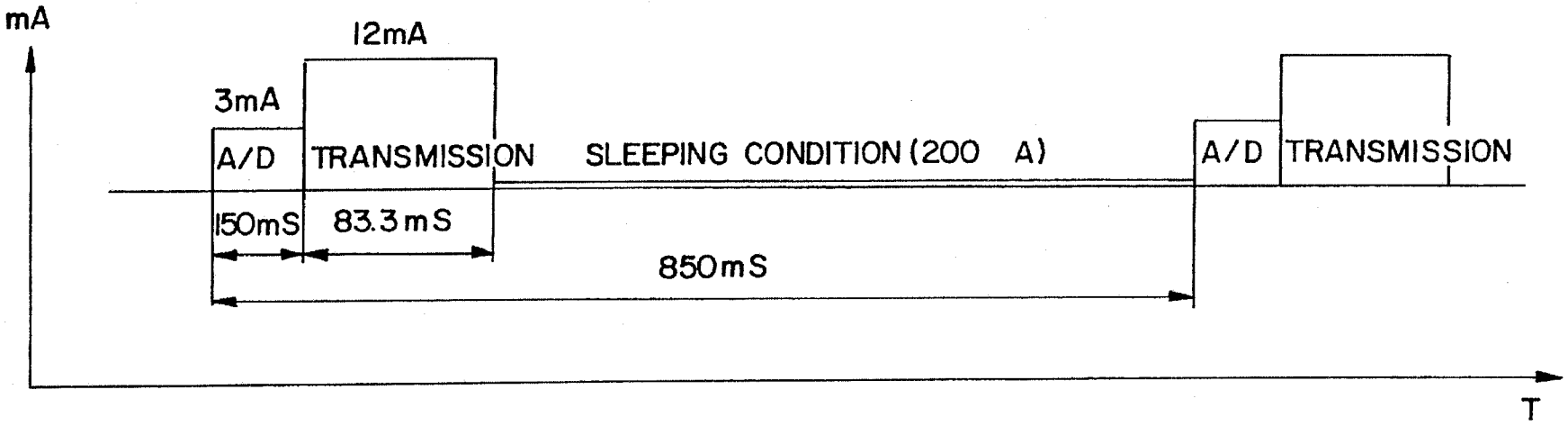
FIG. 9 is a graph disclosing the magnitude of the consumption of energy during transmission.

With reference to FIG. 9, in the case where the electrode signal obtained from the measuring electrode E is A/D converted, and the measured datum obtained by this A/D conversion is wirelessly transmitted to the communication unit $U_M$ in the meter M, the greater part of power consumption in the communication unit $U_E$ is consumed during the transmission of electrical waves. Thus, the present invention adopts a transmission signal format so that when a difference between the measured datum $V_n$, which has been received, and the datum $V_{n-1}$, which has been transmitted on the last transmission cycle, reaches a predetermined set value X or greater, as shown by the flow chart in FIG. 3, the measured datum is considered to have been sufficiently changed to be transmitted. When the difference is less than the predetermined set value X, the datum will not be transmitted.

As a result, the electrical-power consumption in the communication unit $U_M$ can be reduced. Thus, the power source portion 8 can be of a relatively small size, and can also increase in its useful life period. This is a particular advantage in remotely-located measured electrodes that may be difficult to service.

Figure 2:
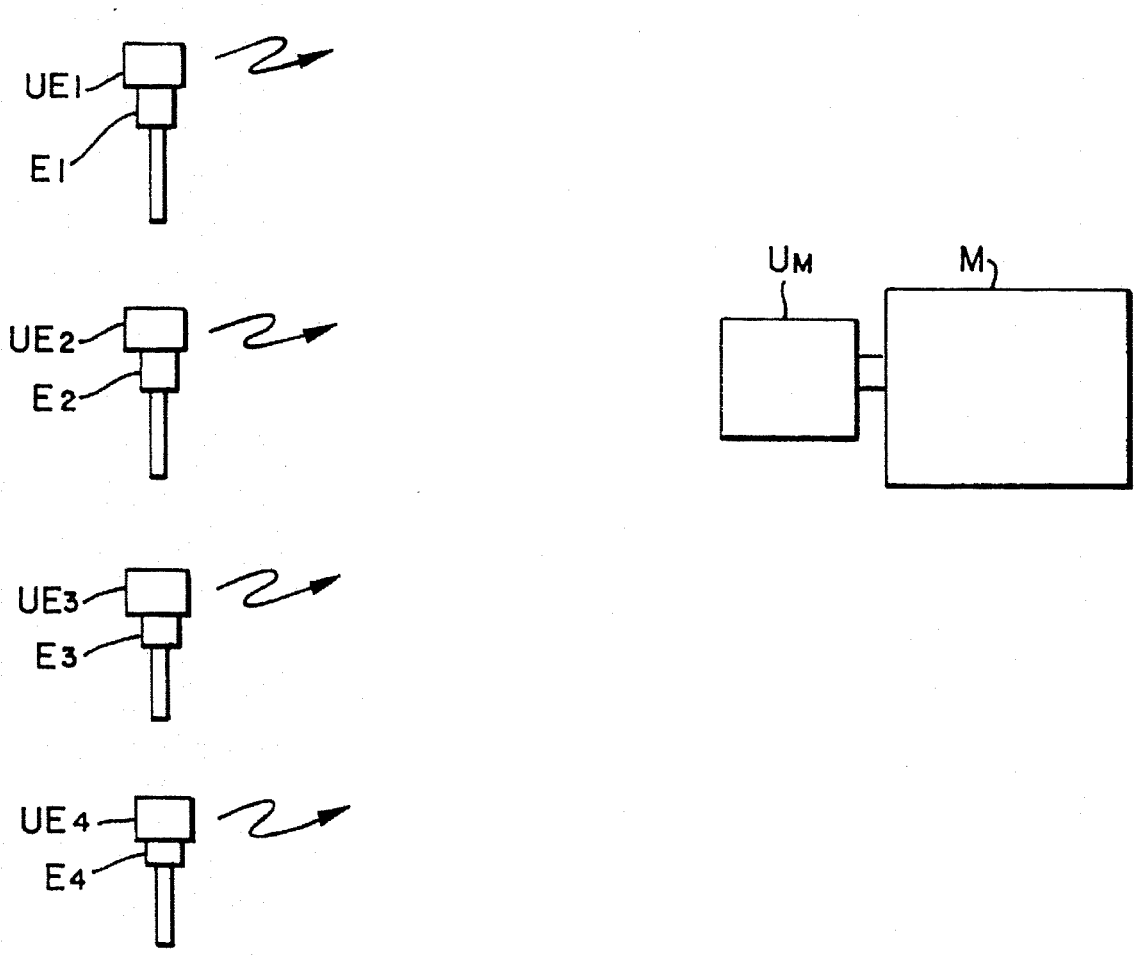
FIG. 2 is a schematic block diagram showing another example of a construction of a single direction communication-type instrumentation system.
Figure 4:
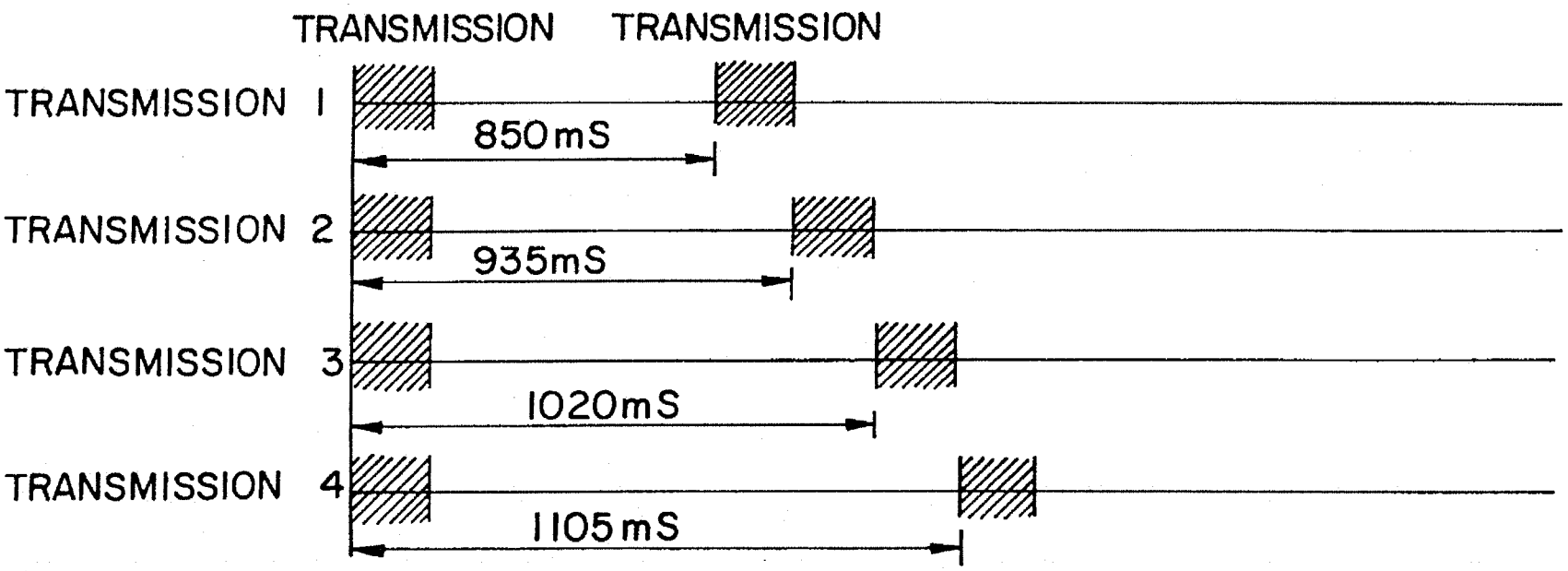
FIG. 4 is a timing chart showing data transmission for a multichannel measurement system in accordance with the present invention.

In addition, in the case where one meter M can service a plurality of measuring electrodes $E_1$ to $E_4$ in a multichannel measurement, as shown in the second preferred embodiment in FIG. 2, if the transmitting intervals are made constant over all of the channels, when the measuring data is to be transmitted at the same frequency, the electrical waves will overlap and, therefore, disturb the normal receiving function. Accordingly, if the transmitting intervals in different channels are made different from each other so that, for example, the four communication channels (transmission 1 to 4) are used as shown in FIG. 4, then the appropriate time spacing between the leading edge of each of the transmission signals can be achieved. In other words, referring to FIG. 4, the transmitting intervals in channels 1 to 4 are adopted to be 850 ms, 935 ms, 1,020 ms, and 1,105 ms, respectively.

In FIG. 4, the initial or start time is shown on the left side of the graph, and the relevant transmission periods are spaced at least 850 ms therefrom and would be relied upon as the actual measurement datum signals. Additionally, the measurement datum signals can be repeatedly broadcast, for example, at intervals of 10 ms to 20 ms within the allotted transmission period of approximately 85 ms.

As a result of these spacing intervals, the probability that the transmissions will overlap among the channels can be greatly reduced. Even if overlapped during an initial transmission, they will not be overlapped during a subsequent transmission where the signals will vary. Thus, the usual measurement will not be disturbed. As noted above, when the difference between the measured datum $V_n$ received and the datum $V_{n-1}$ transmitted is not above a predetermined value, the measured datum is considered not to have changed, and the datum will not be transmitted, thereby providing added spacing in a multichannel measurement system.

Figure 3:
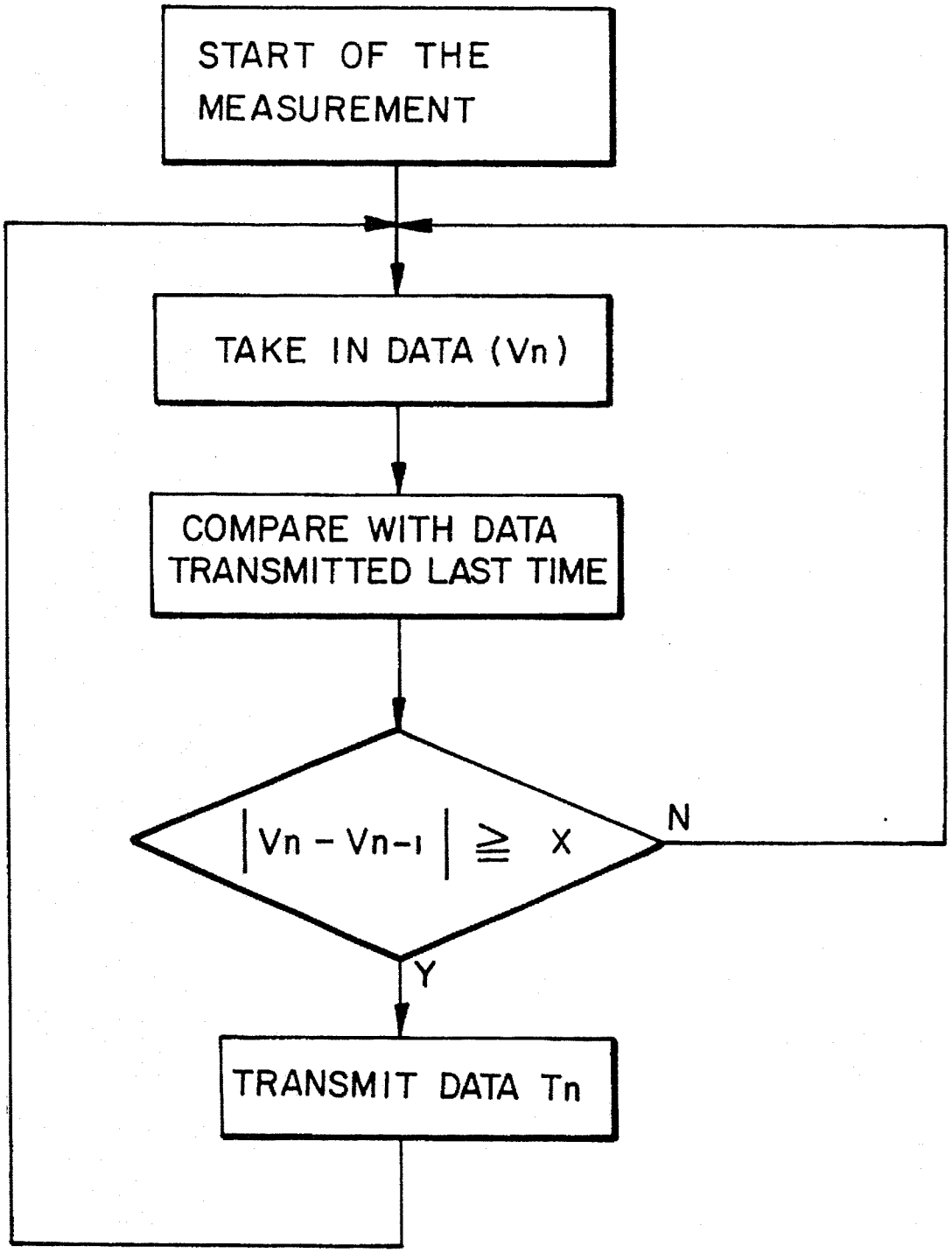
FIG. 3 is a flow chart showing one example of a data transmission process in the present invention.

Thus, the communication unit $U_M$ can initially store the digital value of the measurement datum signal and compare it with the previous measurement datum signal, as shown in FIG. 3, and only transmit during the allocated transmission period when the current measurement datum signal is significantly different. The receiving unit $U_K$ will not receive a signal, and a program stored in the CPU 16 or CPU 11 can interpolate this lack of transmission as a verification of the same measurement datum signal as the last recorded measurement datum signal. The monitoring system can periodically require a positive transmission of the current measurement datum signal regardless of the program requirement of FIG. 3 as a safeguard to verify the operability of the particular measuring electrode.

Although the measuring electrode E is provided with a communication unit $U_E$ having only a transmitting function, and the meter M is provided with the exclusive communication unit $U_M$ having only a receiving function, so that communication may be possible in only one direction in the above-described first and second preferred embodiments, it is clearly understood that the transmissions may be two-way to permit the measuring electrode E to be controlled from the meter.

Figure 5:
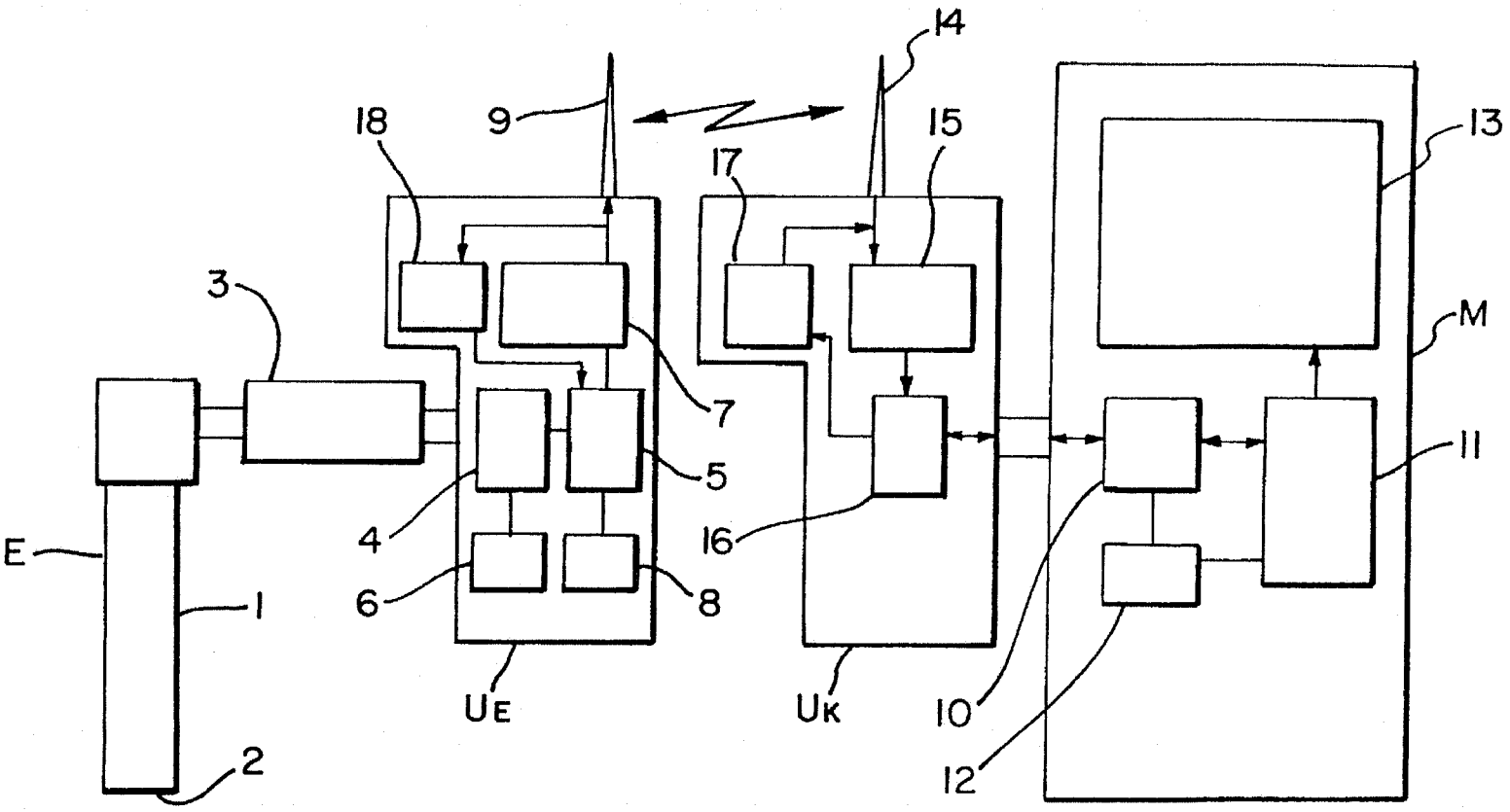
FIG. 5 is a block diagram showing an example of an instrumentation system capable of communicating in a two-way direction according to the present invention.

FIG. 5 discloses a third preferred embodiment of the present invention wherein both the transmission and reception is two-way. In other words, the communication unit $U_K$ is mounted on the meter M and is provided with a high-frequency wave-transmitting portion 17. The communication unit $U_E$ is mounted on the measuring electrode E and is provided with a high-frequency wave-receiving portion for receiving signals from the high-frequency wave-transmitting portion 17, as shown in FIG. 5.

Figure 6:
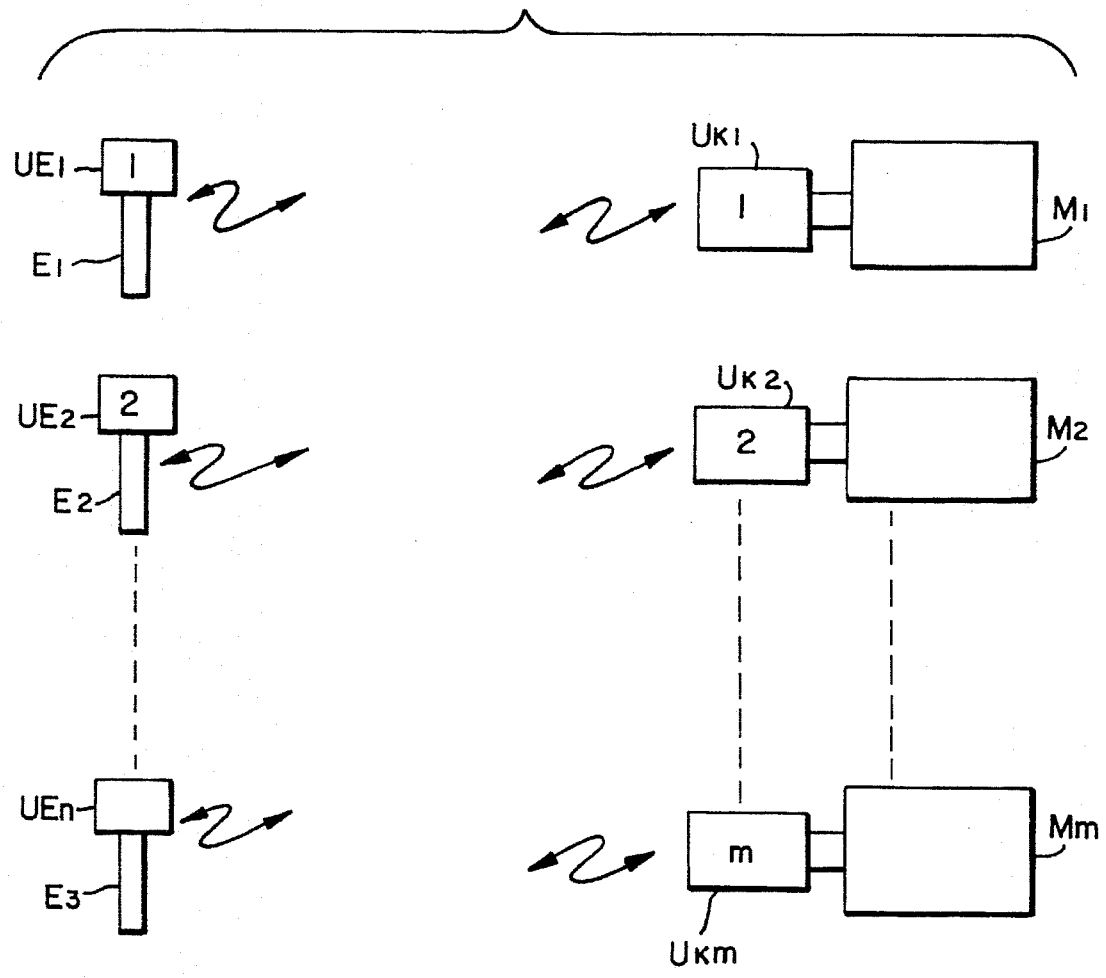
FIG. 6 is a schematic block diagram showing an example of a construction of a multichannel system in accordance with the present invention.
Figure 7:
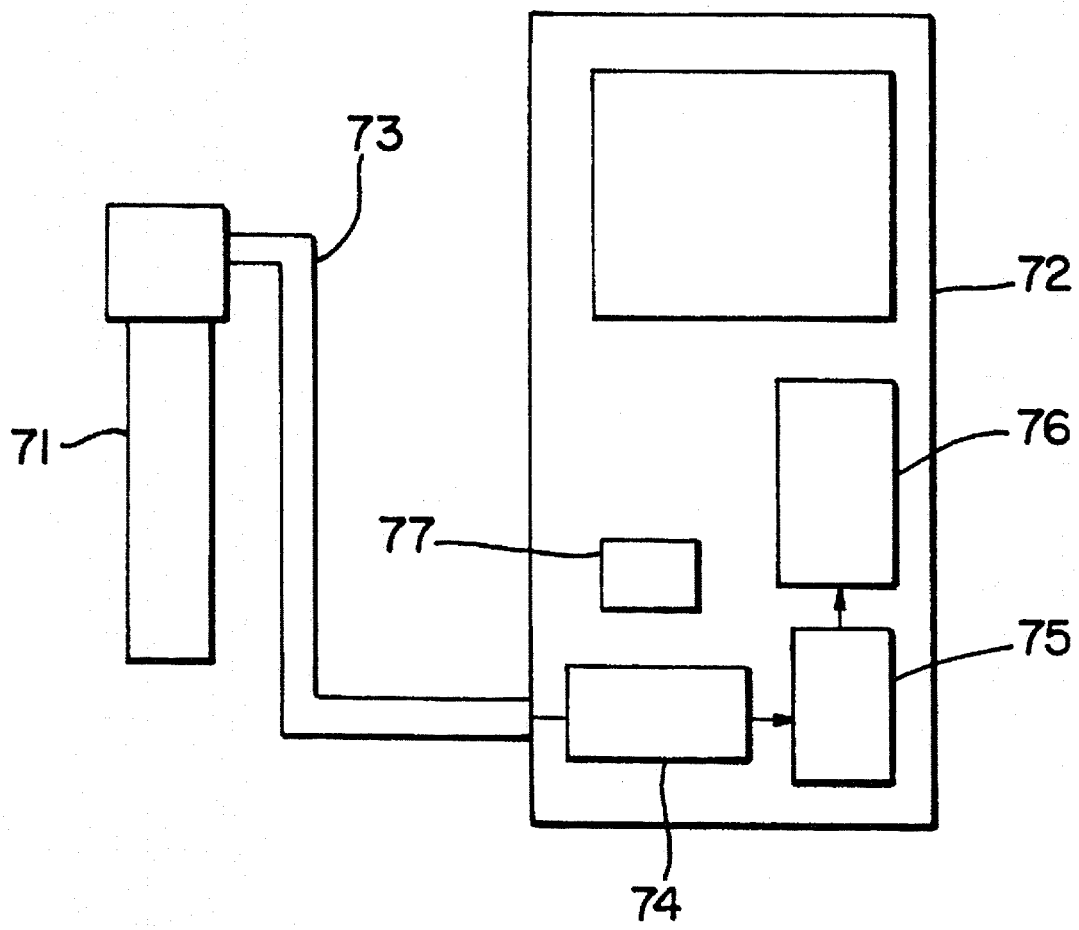
FIG. 7 is a schematic drawing of a conventional measuring system.
Figure 8:
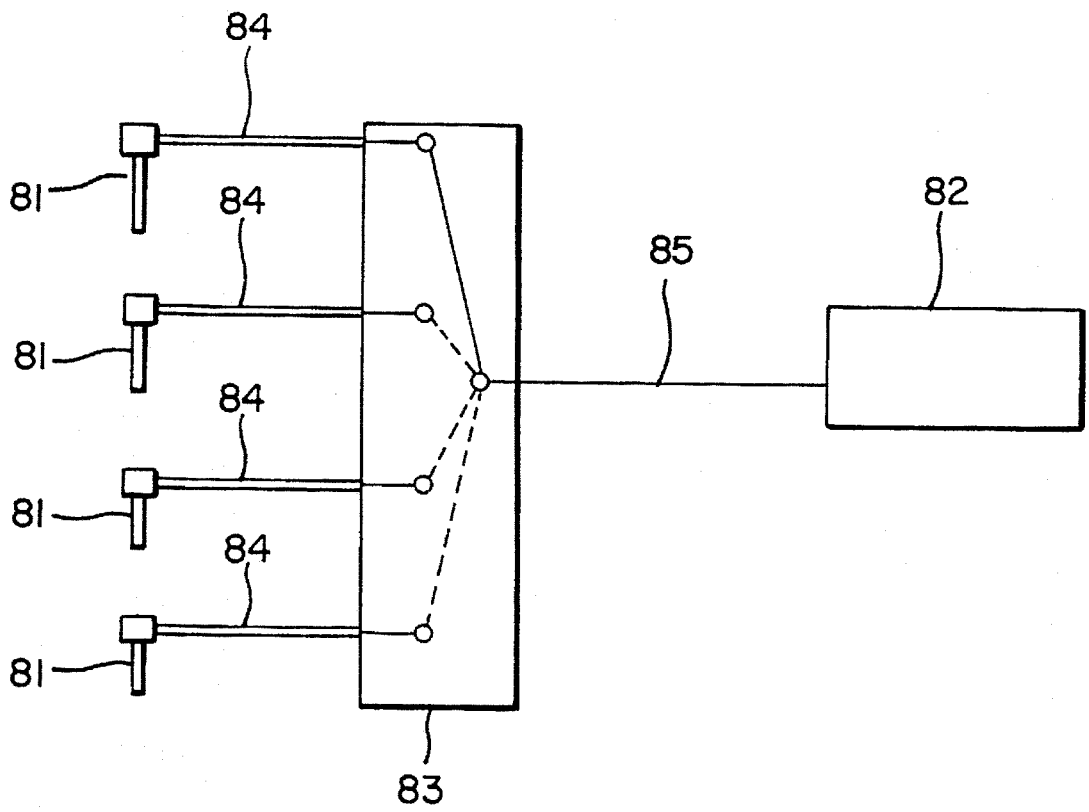
FIG. 8 is a schematic drawing of a conventional multichannel measurement.

Although one measuring electrode E and one meter M are used in the third preferred embodiment shown in FIG. 5, a multichannel system, in which M measuring electrodes E and m measuring meters can be used, as shown in FIG. 6 as a fourth preferred embodiment of the present invention. In such a multichannel system, it is necessary that a datum requirement is output from one of the meters M to one of the measuring electrodes E and a desired measured datum is transmitted to the meter M, from which the datum requirement was transmitted, according to the datum requirement. This procedure may be effectuated in the following manner.

If it is assumed that not only a measuring electrode-discriminating code (analytical portion-discriminating code) is given to the respective n measuring electrodes E, but also a meter-discriminating code to the respective m meters M, the discriminating code of the measuring electrode E which transmits the measured datum to be received by the meter M and the discriminating code on the meter M are transmitted through electrical waves together with the datum requiring code. The respective measuring electrodes E can receive instructions through the transmission to confirm the measuring electrode-discriminating code. This confirmation can also determine whether or not the datum requirement has been performed. The measuring electrode E can respond and have the measuring electrode-discriminating code transmitted with the measured datum together with the discriminating code of the meter M.

Finally, the respective meters M can receive transmissions to confirm a meter-discriminating code and, accordingly, confirm whether or not the measuring datum is addressed. If the measuring datum is addressed by any one of the respective meters, it can be suitably processed and displayed or memorized in the meter. The measured data required by the meter M is transmitted from the measuring electrode E when addressed in accordance with the above procedures. In this manner, a transmission using the stored electrical power is only required when the datum requirement has been accomplished, thereby avoiding any wasteful consumption of power and assuring an accurate measured datum signal.

As can be appreciated, the monitoring system of the present invention is not limited for use with pH meters, but can be used with a wide variety of meters, including ion concentration measuring devices, dissolve oxygen measuring devices, and the like.

In accordance with one preferred embodiment of the present invention, a reduction in consumption of electrical power in the transmitting portion can be promoted while avoiding a reduction of response speed, in comparison with the case where the transmitting intervals of the measured data are increased to reduce the number of times of transmission.

In accordance with another embodiment of the present invention, the chance of the electrical waves being overlapped among the transmission channels can be greatly reduced, and transmission accuracy can be improved.

In accordance with third and fourth embodiments of the present invention, the transmission from the meter to the measuring instrument can become a two-way transmission. Wasteful transmissions can then be prevented and a measured datum can be positively transmitted to a specific meter from which a request is made.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A remote monitoring system for instrumentation measuring certain characteristics of a process comprising:

an instrument for providing a measurement of a process and providing output signals of measurement values;

means for storing a datum value representative of the measurement value of the last transmitted output signal $V_{n-1}$;

comparing means for comparing a current output signal $V_n$ with the stored datum value $V_{n-1}$ of a previous output signal and providing a comparison value signal;

a transmitter connected to the instrument for wirelessly transmitting an output signal;

means for causing the transmitter to transmit a current output signal when the comparison value signal is equal to or greater than a predetermined stored value X in accordance with the following equation:

$$|V_n - V_{n-1}| \geqq X; \text{ and}$$

a receiver means for receiving the transmitted current output signal to provide a measured result of the process.

2. The invention of claim 1, further including means for periodically transmitting, at set time periods, a current output signal equal to or greater than a predetermined value.

3. The invention of claim 1, further including means for converting the measurement output signals at the transmitter into digital values.

4. The invention of claim 1, further including means for providing, at the transmitter, a plurality of different transmission channels.

5. The invention of claim 4, further including means for providing set transmission periods that are distinct from each other for each transmission channel.

6. The invention of claim 1, further including receiving means connected to the transmitter for wirelessly receiving input signals to cause a specific transmission by the transmitter of a current output signal.

7. The invention of claim 1, further including means connected to the transmitter for encoding an instrument identification code with the transmission of the output signal.

8. The invention of claim 1 wherein the instrumentation includes a pH-measuring electrode for providing an output signal representative of a pH value.

9. In a remote monitoring system for a pH meter apparatus comprising a plurality of sensors for providing measurements of pH and providing output signals, a communication system comprising:

means for storing a datum value representative of the measurement value of the last transmitted output signal $V_{n-1}$;

comparing means for comparing a current output signal $V_n$ with the stored datum value $V_{n-1}$ of a previous output signal and providing a comparison value signal;

a transmitter connected to the sensor for wirelessly transmitting an output signal;

means for causing the transmitter to transmit a current output signal when the comparison value signal is equal to or greater than a predetermined value X in accordance with the following equation:

$$|V_n - V_{n-1}| \geqq X; \text{ and}$$

a receiver means for receiving the transmitted current output signals from each transmitter; and means for processing the output signals from the receiver means to provide a pH value for each sensor.

10. The invention of claim 9, further including means for periodically transmitting, at set time periods, a current output signal equal to or greater than a predetermined value from each sensor.

11. The invention of claim 9, further including means for converting the measurement output signals at each transmitter into digital values.

12. The invention of claim 9, further including means for providing, at each transmitter, a plurality of different transmission channels.

13. The invention of claim 12, further including means for providing set transmission periods that are distinct from each other for each transmission channel.

14. The invention of claim 9, further including receiving means, connected to each transmitter, for wirelessly receiving input signals to cause a specific transmission by the transmitter of a current output signal.

15. The invention of claim 9, further including means, connected to each transmitter, for encoding an instrument identification code with the transmission of the output signal.

* * * * *